US007481593B2

(12) United States Patent
Kwan et al.

(10) Patent No.: US 7,481,593 B2
(45) Date of Patent: Jan. 27, 2009

(54) COMBINATION HYDROPHOBIC/HYDROPHILIC FILTERS/RESERVOIRS FOR CONTROLLING FLUID FLOW

(75) Inventors: Wing Sum Vincent Kwan, Chicago, IL (US); Leighton Davies-Smith, Oswego, IL (US)

(73) Assignee: Sanford, L.P., Oak Brook, IL (US)

( * ) Notice: Subject to any disclaimer, the term of this patent is extended or adjusted under 35 U.S.C. 154(b) by 288 days.

(21) Appl. No.: 10/890,781

(22) Filed: Jul. 14, 2004

(65) Prior Publication Data

US 2005/0053416 A1 Mar. 10, 2005

Related U.S. Application Data

(60) Provisional application No. 60/496,301, filed on Aug. 19, 2003.

(51) Int. Cl.
*A46B 11/04* (2006.01)
*A47L 13/22* (2006.01)

(52) U.S. Cl. ..... 401/270; 401/198

(58) Field of Classification Search ..... 401/196–199, 401/202–207, 268–270
See application file for complete search history.

(56) References Cited

U.S. PATENT DOCUMENTS

| | | | | |
|---|---|---|---|---|
| 113,305 | A | 4/1871 | Kellogg | |
| 469,990 | A | 3/1892 | Brewington | |
| 753,593 | A | 3/1904 | Langill | |
| 907,850 | A | 12/1908 | Mountford | |
| 1,526,093 | A | 2/1925 | Rockman | |
| 1,621,432 | A | 3/1927 | Rockman | |
| 1,693,330 | A | 11/1928 | Astley | |
| 1,694,306 | A | 12/1928 | Astley | |
| 1,935,639 | A | 11/1933 | Keeshan | |
| D108,577 | S | 2/1938 | Mureau | |
| D175,548 | S | 9/1955 | Kane | |
| 3,061,868 | A | 11/1962 | Miller | |
| 3,113,336 | A * | 12/1963 | Langnickel | 401/206 |
| 3,149,458 | A * | 9/1964 | Harris | 60/207 |
| 3,565,540 | A | 2/1971 | Andrews | |

(Continued)

FOREIGN PATENT DOCUMENTS

| | | |
|---|---|---|
| DE | 36 42 037 | 6/1988 |

(Continued)

OTHER PUBLICATIONS

International Search Report for International (PCT) Patent Application No. PCT/US2005/025180 dated Feb. 6, 2006.

(Continued)

*Primary Examiner*—Huyen Le
(74) *Attorney, Agent, or Firm*—Marshall, Gerstein & Borun LLP

(57) ABSTRACT

A fluid control system for writing instruments, correction fluid dispensers and self contained paint brush and paint reservoirs is disclosed. The fluid control system includes two filters or reservoirs, including a hydrophobic filter/reservoir and a hydrophilic filter/reservoir. The hydrophobic and hydrophilic elements may be spaced adjacent to and in abutting engagement with each other or a gap or space may be disposed therebetween. The hydrophobic element is disposed adjacent to the fluid reservoir (i.e., ink, correction fluid, paint reservoir or other water based fluid) and the hydrophilic element is disposed adjacent to the applicator tip or brush.

23 Claims, 1 Drawing Sheet

U.S. PATENT DOCUMENTS

| | | | | |
|---|---|---|---|---|
| D260,406 | S | 8/1981 | Itoh | |
| D271,212 | S | 11/1983 | Itoh | |
| 4,496,258 | A * | 1/1985 | Tanaka et al. | 401/206 |
| 4,588,319 | A | 5/1986 | Niemeyer | |
| 4,671,692 | A | 6/1987 | Inaba | |
| 4,792,252 | A | 12/1988 | Kremer et al. | |
| 4,913,175 | A | 4/1990 | Yokosuka et al. | |
| 4,970,854 | A | 11/1990 | Komiya et al. | |
| 4,997,301 | A | 3/1991 | Sheu | |
| 5,092,702 | A | 3/1992 | Kurokawa | |
| 5,169,467 | A | 12/1992 | Komiya et al. | |
| 5,279,499 | A | 1/1994 | Carter | |
| 5,290,116 | A | 3/1994 | Chang | |
| D363,307 | S | 10/1995 | Shikuwa | |
| 5,607,766 | A | 3/1997 | Berger | |
| 5,927,885 | A * | 7/1999 | Duez et al. | 401/199 |
| 5,971,646 | A | 10/1999 | Chavatte et al. | |
| 6,210,063 | B1 | 4/2001 | Isobe et al. | |
| 6,227,741 | B1 * | 5/2001 | Quercioli | 401/199 |
| 6,322,269 | B1 | 11/2001 | Witz et al. | |
| D454,158 | S | 5/2002 | Takanashi | |
| 6,386,781 | B1 | 5/2002 | Gueret | |
| 6,488,429 | B2 | 12/2002 | Korper | |
| 6,503,015 | B1 | 1/2003 | Bianco, Jr. | |
| 6,572,297 | B2 | 6/2003 | Korper | |
| 7,237,970 | B2 * | 7/2007 | Bolton | 401/35 |
| 2002/0025214 | A1 | 2/2002 | Korper | |
| 2002/0054783 | A1 | 5/2002 | Gueret | |
| 2002/0168215 | A1 | 11/2002 | Witz et al. | |
| 2002/0186997 | A1 | 12/2002 | Kim | |
| 2002/0192010 | A1 | 12/2002 | Korper | |
| 2003/0123922 | A1 | 7/2003 | Kabayashi et al. | 401/206 |

FOREIGN PATENT DOCUMENTS

| | | |
|---|---|---|
| DE | 3642037 A1 * | 6/1988 |
| EP | 0 726 166 | 8/1996 |
| JP | 10272883 | 10/1998 |
| JP | 2001279153 | 10/2001 |
| WO | WO-99/28046 | 6/1999 |
| WO | WO-02/100658 | 12/2002 |

OTHER PUBLICATIONS

Written Opinion of the International Searching Authority for International (PCT) Patent Application No. PCT/US2005/025180 dated Feb. 6, 2006.

Translation of DE 36 42 037 A1 (German language document previously submitted on May 4, 2006).

* cited by examiner

COMBINATION HYDROPHOBIC/HYDROPHILIC FILTERS/RESERVOIRS FOR CONTROLLING FLUID FLOW

CROSS-REFERENCE TO RELATED APPLICATION

This application claims the benefit under 35 U.S.C. § 119 (e) of U.S. Provisional Patent Application Ser. No. 60/496,301, filed Aug. 19, 2003, the disclosure of which is incorporated herein by reference.

BACKGROUND

1. Technical Field

A substitute for a mechanical valve with moving parts for fluid dispensing instruments such as writing instruments and painting instruments is disclosed. More specifically, instead of a mechanical valve such as a ball valve, needle valve, or duck bill valve, a combination of filters is substituted for a mechanical valve. Still more specifically, a combination of hydrophobic and hydrophilic filters are used to control the flow of ink, paint correction fluid or any other water based fluids from a flexible barrel reservoir to the tip, brush or applicator of the instrument. Still more specifically, a hydrophobic filter media is disposed between the fluid supply and a hydrophilic filter media. The hydrophilic filter media is disposed between the brush tuft, pen tip or applicator tip and the hydrophobic filter media. Manual pressure applied to the flexible barrel holding the fluid will force the fluid through the hydrophobic filter media and to the hydrophilic filter media. The hydrophilic filter media will deliver a controlled flow of fluid to the applicator tip.

2. Background of the Related Art

In fluid dispensing instruments such as ink pens, gravitational and capillary forces are the two principal means for migrating ink from the reservoir to the tip are employed. In one system, the ink is stored in a narrow tubular reservoir that is connected to a tip. Ink flows from the reservoir through the tip by way of the capillary and gravitational forces.

Another system includes storing the ink in a fiber structure often referred to as a reservoir. The fiber reservoir is saturated with ink which flows from the fiber reservoir to the tip by way of both capillary and gravitational forces. The tip may be an extension of the fiber reservoir or may be a separate member with a collection tube or other structure that is embedded in the fiber reservoir.

Some instruments similar to writing instruments, require the application of pressure by way of the user's hand onto a flexible barrel containing the fluid to be dispensed in order to deliver the fluid through the tip. Specifically, instruments containing correction fluid are now offered in a "pen-shape" form which requires the user to apply pressure to the flexible barrel or reservoir in order to deliver correction fluid through the ball point tip. In contrast, fountain pens include a tip that is directly coupled to a liquid reservoir of ink and both capillary and gravitational forces deliver the ink to the fountain tip.

Further, more exotic writing instruments may include valve systems such as check valves or duckbill valves to help control the flow of ink or writing fluid to the tip. Such mechanical valve systems in writing instruments can be very costly due to the small size of such writing instruments. Further, mechanical valves can be unreliable due to the very nature of a writing instrument which is small, prone to be dropped or handled roughly and used in a wide range of ambient temperatures.

Thus, while writing instruments and correction fluid instruments may come in a variety of forms, none of the fluid delivery mechanisms are without their deficiencies. For example, while the capillary action of a ball point pen is dependable and long lasting, ball point pen apply a very thin coated of ink to the paper and are not preferred writing instruments by consumers for looking for bolder lines. On the other hand, felt tip pens provide a bolder, darker line but are prone to inconsistent ink delivery and premature drying out. Other roller-type pens that attempt to serve as a hybrid between a fountain pen and a ball point pen are prone to premature failure. Further, inexpensive pens that depend on gravity for ink flow will not work properly when the pen tip is disposed vertically above the ink reservoir.

Currently available correction fluid instruments that require the user to squeeze the barrel to apply the fluid operate inconsistently and are awkward to use due to the large amount of force required to be imposed upon the barrel in order to create the desired correction fluid flow. Any writing instrument with a mechanical valve disposed between the ink reservoir and the tip is expensive to manufacture and prone to failure for the reasons set forth above.

Therefore, there is a need for an improved fluid control system between an ink, paint, correction fluid or other liquid reservoir and a writing tip, brush or applicator tip.

Further, in the field of artist supplies, and more specifically, paint, an artist typically uses numerous brushes along with a pallet on which a variety of paint colors is disposed. While this system has been utilized for centuries, there is a demand for paint brushes that include their own reservoir of paint or ink which would eliminate the need for a separate pallet and, in the case of water colors, separate jars or bowls of water for the purpose of cleaning and wetting the brushes. Specifically, there is a demand for individual water color brushes which include a reservoir of water color connected to the brush. However, there currently is no satisfactory fluid control system for controlling the flow of water color from the reservoir to the brush tip. Thus, there is also a need for an improved control system for controlling fluid flow between a barrel reservoir and a brush tip of a water color paint brush applicator.

SUMMARY OF THE DISCLOSURE

In satisfaction of the aforenoted needs, a "chemical" valve system between a barrel reservoir and an applicator tip such as a pen tip, brush or fluid applicator, is disclosed.

In an embodiment, the valve or control system comprises two filters including a hydrophobic filter and a hydrophilic filter. In an embodiment, the hydrophobic is disposed between the hydrophilic filter and the barrel reservoir. Further, in an embodiment, the barrel reservoir includes a flexible shell which permits the user to generate pressure in the reservoir by squeezing the barrel. Upon squeezing the barrel, fluid pressure is generated in the reservoir and fluid is forced through the hydrophobic filter towards the hydrophilic filter. Then, the fluid is drawn through the hydrophilic filter in a controlled manner to the writing tip, brush, applicator tip or applicator brush.

In a refinement, the hydrophobic and hydrophilic reservoirs are spaced apart and are disposed within a ferrule.

In another refinement, the hydrophobic and hydrophilic reservoirs are in abutting engagement with each other and disposed between the fluid reservoir and the applicator tip.

The above-referenced fluid control system is applicable to ink pens, correction fluid pens and paint brushes, such as self contained water color paint brushes whereby a brush is connected to a barrel reservoir containing water color with the disclosed fluid control system disclosed therebetween. The disclosed fluid control system will also be applicable to the delivery of other water based fluids through a tip, brush or applicator.

BRIEF DESCRIPTION OF THE DRAWINGS

The disclosed embodiments are described more or less diagrammatically in the accompanied drawings, wherein.

DETAILED DESCRIPTION OF THE PRESENTLY PREFERRED EMBODIMENTS

Figure 1:
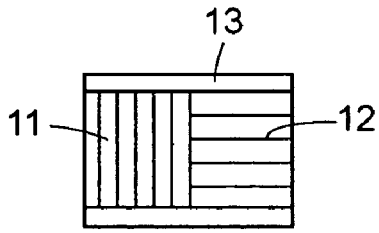
FIG. 1 is a partial sectional view of a ferrule containing a hydrophobic filter element and hydrophilic filter element of controlling fluid flow to an applicator tip in accordance with this disclosure.

Turning to FIG. 1, a hydrophobic filter element 11 and a hydrophilic filter element 12 are disposed within a collar 13 or other containment system. The collar 13 or other structure may be connected between a reservoir and an applicator tip as discussed below with respect to FIGS. 3 and 4. The hydrophobic and hydrophilic filters or reservoirs 11, 12 can be obtained from a number of different sources.

Once such source is Filtrona of Colonial Heights, Va. Hydrophobic reservoirs or filters 11 are typically made from polypropylene or other non-polar polymers with a carbon backbone. Such non-polar polymers, when incorporated into a filter reservoir to form a hydrophobic filter, lack an affinity for water or, in other words, repel water. Suitable hydrophobic filter materials include aromatic polymers and halogenated polymers. Other materials suitable for fabricating the hydrophobic reservoir or filter 11 include but are not limited to: rubber; certain polyesters; polyurethane; polyhydrocarbons like polyethylene and polystyrene; acrylates; carbonates; chlorinated polymers; polyaromatic esters like poly(butylene terephthalate); ethers like polyethersulfone; polyetheretherketone; fluorinated polymers like poly(vinylidene fluoride); methacrylates; polyvinyl chloride; higher vinyl acetates; cellulose-esters; and mixtures of the above. Other suitable materials for fabricating hydrophobic filters or hydrophobic reservoirs shown at 11 in FIGS. 1 and 2 will be apparent to those skilled in the art.

Conversely, hydrophilic filter or reservoir elements 12 may be fabricated from non-polar polymers, often with hydroxy groups disposed on the polymer backbone. Another suitable polymer component for a hydrophilic filter 12 is polysulfone. Other hydrophilic materials for fabricating the hydrophilic filter or reservoir 12 include: cellulose-based fibers like stem of flax and Hemp, shell of coconut or cotton; protein-based fibers like animal hair, wool or silk; mineral-based like asbestos, chrysotile; nylons; polyamides; glass; metal; and silicate. Still other suitable hydrophilic materials for the filter 12 will be apparent to those skilled in the art.

Though fibers of different materials can be used to render a reservoir hydrophobic, hydrophilic fibers can be rendered hydrophobic by surface modification techniques. These techniques include surface coating and grafting. By the same virtue, a hydrophobic reservoir can be made hydrophilic through plasma treatment or ozonolysis.

Figure 2:
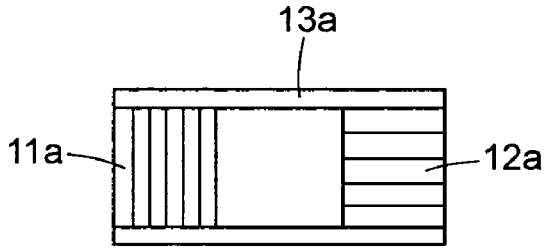
FIG. 2 is another partial sectional view of a ferrule containing a hydrophobic element and hydrophilic filter element with a gap or space disposed therebetween.
Figure 3:
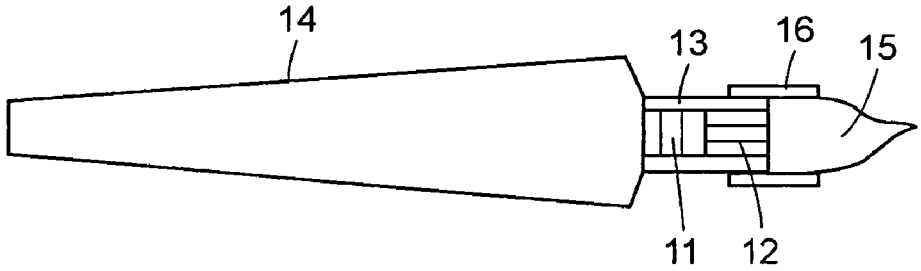
FIG. 3 is a sectional view illustrating the fluid control or filter system of FIG. 1 as connected to a barrel reservoir and a brush tuft.

As shown in FIG. 1, one embodiment includes the hydrophobic filter or reservoir 11 disposed adjacent to or in abutting engagement with the hydrophilic filter or reservoir 12. As shown in FIG. 2, an alternative embodiment may include a longer collar or ferrule 13*a* so that the hydrophobic filter or reservoir 11 a may be spaced apart from the hydrophilic filter or reservoir 12*a*. As shown in FIG. 3 the collar 13 may be attached to a barrel-type reservoir 14. Further, the collar or ferrule 13 may be directly or indirectly connected to a brush or applicator tip shown at 15. That is, an additional ferrule 16 may be employed or the tip 15 may be connected to the collar or ferrule 13 in a more direct manner that will be apparent to those skilled in the art. The barrel reservoir 14 may accommodate ink, a water color paint, correction fluid or other water based fluid that needs to be dispensed through an applicator tip, pen tip, nib, or brush such as that shown at 15 in FIG. 3.

Figure 4:
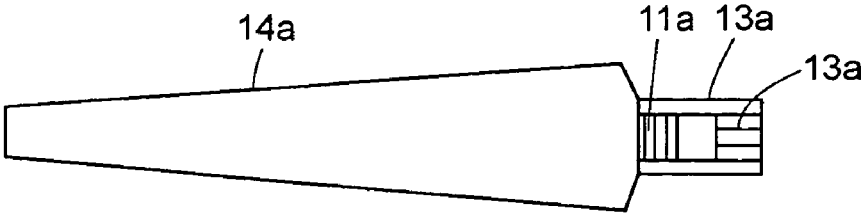
FIG. 4 is a sectional view of the fluid control or filter system of FIG. 2 as attached to a barrel reservoir.

An analogous embodiment is illustrated in FIG. 4 for the spaced apart filter elements 11*a*, 12*a* shown in FIG. 2.

In addition to using two different filter or reservoir elements 11, 12 that hydrophobic and hydrophilic respectively, other "chemical" type control valves or systems may be employed also based upon the difference in chemical affinity of the fluid being transported and the valve material. Such other systems would include two filter elements with different electrostatic interactions, two filter elements with different acidities or different acid-base reactions, two different filter elements with complimentary and non-complimentary hydrogen bonding, and two different filter elements with different metal-ligand affinities. Some molecules have special affinities towards other molecules. In the metal-ligand interaction, the ligand interacts or binds with a metal center by donating its lone pair of electrons (as in dative bond formation). An example can be using a reservoir with phenolic fiber inside to restrict the flow of a liquid enriched in iron ions. Since there is a strong interaction between phenol and iron ions, the flow of the iron will be slowed down owing to its interaction with the phenolic moieties in the fibers.

Working examples of the hydrophobic/hydrophilic reservoir 11, 12 system as shown in FIG. 1 is provided by way of Example 1 below. Further, Example 2 is provided below for further illustrating the benefit provided by combining the hydrophilic reservoir 12 with a hydrophobic reservoir 11.

EXAMPLE 1

A hydrophobic reservoir 11 (density=0.4 g/cc, 5.5 OD×3 mm) and a hydrophilic reservoir 12 of various lengths (both are from Filtrona, Colonial Heights, Va.) were connected together using a Tigon tubing. The reservoir 11, 12 combination was connected to the ink barrel 14 of a color brush with the hydrophobic 11 side facing the ink. The force applied onto the barrel body 14 to squeeze the ink out was measured. Table 1 depicts the result of this experiment.

TABLE 1

The pressure (force) needed to effect fluid flow across reservoirs/filters 11, 12 of various lengths of the hydrophilic segment.

| Force Required | Length of Hydrophilic reservoirs (12) in mm | | |
|---|---|---|---|
| (kg) | 3 | 5 | 8 |
| Initial Flow to tip (kg) | 1.2 | 1.25 | 1.3 |
| To have the first drop of water dripping out | 1.2 | 1.25 | 1.3 |

EXAMPLE 2

Color brushes 15 incorporating hydrophobic reservoirs 11 (5.5 mm OD×3 mm) of various densities (0.4, 0.344, 0.289 g/cc) were prepared. A hydrophilic reservoir 12 was not included in this test. The force applied onto the barrel body 14 to squeeze the ink out was measured for these color brushes. Table 2 depicts the result of this experiment.

TABLE 2

The pressure (force) needed to effect fluid flow across hydrophobic reservoir/filter 11 of various densities.

| Force Required | Density of Hydrophobic reservoirs (11) in gram per cc | | |
|---|---|---|---|
| (kg) | 0.4 | 0.344 | 0.289 |
| Initial Flow to tip (kg) | 2.8 | 0.89 | 0.59 |
| To have the first drop of water dripping out | 3.3 | 1.49 | 1.21 |

Thus, the layer force required for the structure with the hydrophobic filter element 12 only (i.e., without the hydrophilic element) illustrates the benefit of controlled flow with reduced pressure provided by the hydrophobic/hydrophilic filter combination 11, 12 of this disclosure.

While only certain embodiments have been set forth, alternative embodiments and various modifications will be apparent from the above description to those skilled in the art. These and other alternatives are considered equivalents and within the spirit and scope of this disclosure.

What is claimed is:

1. A fluid applicator comprising:

a flexible reservoir containing a fluid, the reservoir comprising an open end connected to a proximal end of a collar, the collar comprising a distal end connected to an applicator, the collar providing communication between an interior of the reservoir and the applicator, the collar accommodating a filter comprising a hydrophobic filter media portion and a hydrophilic filter media portion, the filter disposed outside of the reservoir between the reservoir and the applicator.

2. The fluid applicator of claim 1 wherein at least a portion of the hydrophobic filter media and at least a portion of the hydrophilic filter media are interdispersed.

3. The fluid applicator of claim 1 wherein the hydrophobic filter media portion is made from a material selected from the group consisting of rubber, polyethylene, polyester, polyurethane, polystyrene, polyacrylate, polycarbonate, chlorinated polymer, polyaromatic ester, polyether, fluorinated polymer, methacrylate, polyvinyl acetate, cellulose-ester, and mixtures of the above.

4. The fluid applicator of claim 1 wherein the hydrophilic filter media portion is made from a material selected from the group consisting of polysulfone, flax fiber, hemp fiber, shell of coconut fiber, cotton fiber, animal hair, wool, silk, asbestos, chrysotile, nylon, polyamide, glass, metal, polysilicate and mixtures thereof.

5. The fluid applicator of claim 4 wherein the hydrophobic filter media portion is made from a material selected from the group consisting of rubber, polyethylene, polyester, polyurethane, polystyrene, polyacrylate, polycarbonate, chlorinated polymer, polyaromatic ester, polyether, fluorinated polymer, methacrylate, polyvinyl acetate, cellulose-ester, and mixtures of the above.

6. The fluid applicator of claim 1 further comprising a ferrule that connects the distal end of the collar to the applicator.

7. The fluid applicator of claim 1 wherein the applicator is a tufted brush.

8. The fluid applicator of claim 1 wherein the collar is integrally connected to the reservoir.

9. The brush of claim 1 wherein the applicator is an ink or paint brush.

10. The brush of claim 1 wherein the applicator is a piece of foam or sponge material.

11. The fluid applicator of claim 1, wherein the fluid comprises an aqueous fluid and the hydrophobic filter media portion of the filter is in direct fluid communication with the reservoir.

12. The fluid applicator of claim 1, wherein the fluid comprises an aqueous fluid and the filter constitutes the hydrophobic and hydrophilic filter media portions, and the applicator does not directly contact the reservoir.

13. The fluid applicator of claim 12, wherein the reservoir does not directly communicate with the hydrophilic filter media portion.

14. An ink or paint brush comprising:

a flexible reservoir having an interior accommodating an ink or paint solution, the reservoir comprising an open end connected to a proximal end of a collar, the collar comprising a distal end connected to a brush, the collar providing communication between an interior of the reservoir and the brush, the collar accommodating a filter comprising a hydrophobic filter media portion and a hydrophilic filter media portion, the filter disposed outside of the reservoir between the reservoir and the applicator.

15. The brush of claim 14 wherein at least a portion of the hydrophobic filter media and at least a portion of the hydrophilic filter media are interdispersed.

16. The brush of claim 14 wherein the hydrophobic filter media portion is made from a material selected from the group consisting of rubber, polyethylene, polyester, polyurethane, polystyrene, polyacrylate, polycarbonate, chlorinated polymer, polyaromatic ester, polyether, fluorinated polymer, methacrylate, polyvinyl acetate, cellulose-ester, and mixtures of the above.

17. The brush of claim 14 wherein the hydrophilic filter media portion is made from a material selected from the group consisting of polysulfone, flax fiber, hemp fiber, shell of coconut fiber, cotton fiber, animal hair, wool, silk, asbestos, chrysotile, nylon, polyamide, glass, metal, polysilicate and mixtures thereof.

18. The brush of claim 17 wherein the hydrophobic filter media portion is made from a material selected from the group consisting of rubber, polyethylene, polyester, polyurethane, polystyrene, polyacrylate, polycarbonate, chlorinated polymer, polyaromatic ester, polyether, fluorinated polymer, methacrylate, polyvinyl acetate, cellulose-ester, and mixtures of the above.

19. The brush of claim 14 further comprising a ferrule that connects the distal end of the collar to the brush.

20. The brush of claim 14 wherein the collar is integrally connected to the reservoir.

21. The fluid applicator of claim 14, wherein the ink or paint solution comprises an aqueous ink or paint solution and the hydrophobic filter media portion of the filter is in direct fluid communication with the reservoir.

22. The fluid applicator of claim 14, wherein the ink or paint solution comprises an aqueous ink or paint solution and the filter constitutes the hydrophobic and hydrophilic filter media portions, and the brush does not directly contact the reservoir.

23. The fluid applicator of claim 22, wherein the interior of the reservoir does not directly communicate with the hydrophilic filter media portion.

* * * * *